US006416422B1

(12) United States Patent
Nagai et al.

(10) Patent No.: US 6,416,422 B1
(45) **Date of Patent: *Jul. 9, 2002**

(54) GOLF CLUB HEAD WITH BOUNCE CHANNEL

(75) Inventors: Masao Nagai, Duluth; David Llewellyn, Norcross, both of GA (US)

(73) Assignee: Mizuno Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/759,973

(22) Filed: Jan. 12, 2001

(51) Int. Cl.[7] ..... A63B 53/04
(52) U.S. Cl. ..... 473/328
(58) Field of Search ..... 473/324, 328, 473/344, 244, 345, 346; D21/733, 752, 753, 759

(56) References Cited

U.S. PATENT DOCUMENTS 3,068,011 A * 12/1962 Sano
3,997,170 A * 12/1976 Goldberg
4,065,133 A 12/1977 Gordos
5,257,786 A 11/1993 Gorman
D343,665 S 1/1994 Feche et al.
D345,403 S 3/1994 Sanchez
5,467,988 A * 11/1995 Henwood
5,524,890 A 6/1996 Kim et al.
5,643,107 A * 7/1997 Gorman
D410,057 S 5/1999 Ortiz
6,056,649 A * 5/2000 Imai
6,257,991 B1 * 7/2001 Ortiz
D446,567 S * 8/2001 Nagai

* cited by examiner

*Primary Examiner*—Sebastiano Passaniti
(74) *Attorney, Agent, or Firm*—Troutman Sanders LLP; Gerald R. Boss

(57) ABSTRACT

A golf club head having a sole portion which includes a first and second outside runner carried by the sole portion. The outside runners are offset from one another to define a deflection channel. A deflection element is carried within the deflection channel. The deflection element has a front and a rear and an intermediary portion which extends from the front to the rear. The intermediary portion rises from the front towards the rear to a general height. The height of the intermediary portion of the deflection element does not exceed the height of the first and second outside runners.

11 Claims, 3 Drawing Sheets

GOLF CLUB HEAD WITH BOUNCE CHANNEL

This invention relates generally to golf woods and more particularly to a golf wood having a pair of offset runners carried by the sole of the wood and also including a deflection element within the offset of the runners for inhibiting the golf wood from embedding into the ground during a swing.

BACKGROUND OF THE INVENTION

Golf clubs known as woods are used for hitting the ball off the tee, from the fairway and possibly from the rough. Specific woods are utilized depending on the shot. For instance, a driver is generally used for tee shots while fairway woods are utilized for hitting the golf ball from the fairway or rough. Since a tee shot involves hitting a golf ball from an elevated tee while a fairway or rough shot involves hitting a golf ball from the ground, these particular woods generally have different sole patterns.

When striking a golf ball from the ground, the golfer must use caution to prevent striking the ground. In order for a golfer to obtain the most distance for a given effort, the golf club head must be traveling at its maximum velocity as the face of the golf club interacts with the golf ball. However, should the golfer strike the ground with the wood, the head may slow down if the club head digs too deep into the ground thus decreasing the velocity of the club head and consequently decreasing the flight of the golf ball. This event is known as duffing. Furthermore, the striking of the ground is so feared that many times the golfer will pull up on the shot resulting in a "topped" shot where only the top portion of the golf ball is struck. Neither duffing or topping is desirable.

Additionally, when the golf ball lies in the rough, tall grass extends around the ball. Thus, the golf club must pass through the grass when hitting the ball. However, interaction with the grass may cause the club head to twist and thus produce an errant shot.

Some woods have been designed to aid the golfer from duffing or topping. For instance, U.S. Pat. No. 3,761,095 discloses a wood which has a longitudinal keel with concave sides to assist the club in traveling through the rough. U.S. Pat. No. 3,815,921 illustrates a protrusion on the bottom of a fairway wood which forms an obstruction which will cause the club head to be relatively raised or lifted in a follow through stroke. Other patents exist which include parallel protrusions.

While the prior art fairway woods are suitable for their intended purposes, certain disadvantages may exist if the extending protrusions, known as runners, dig excessively into the ground thereby slowing the club head down.

Accordingly, it is an object of the present invention to provide an improved wood which impedes sole runners from imbedding into the ground.

Also, it is an object of the present invention to provide an improved wood which includes runners and a bounce channel which deters the runners from imbedding into the ground.

SUMMARY OF THE INVENTION

A golf club head having a sole portion includes a first and second outside runner carried by the sole portion. The outside runners are offset from one another to define a deflection channel. The first and second outside runners each have a front edge depending from the sole portion to define a general height. The front edges transition to a generally level horizontal platform. The generally level horizontal platform extends in a front to back direction. A deflection element is carried within the deflection channel. The deflection element has a front and a rear and an intermediary portion which extends from the front to the rear. The intermediary portion rises from the front towards the rear to a general height. The height of the intermediary portion of the deflection element does not exceed the height of the first and second outside runners.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
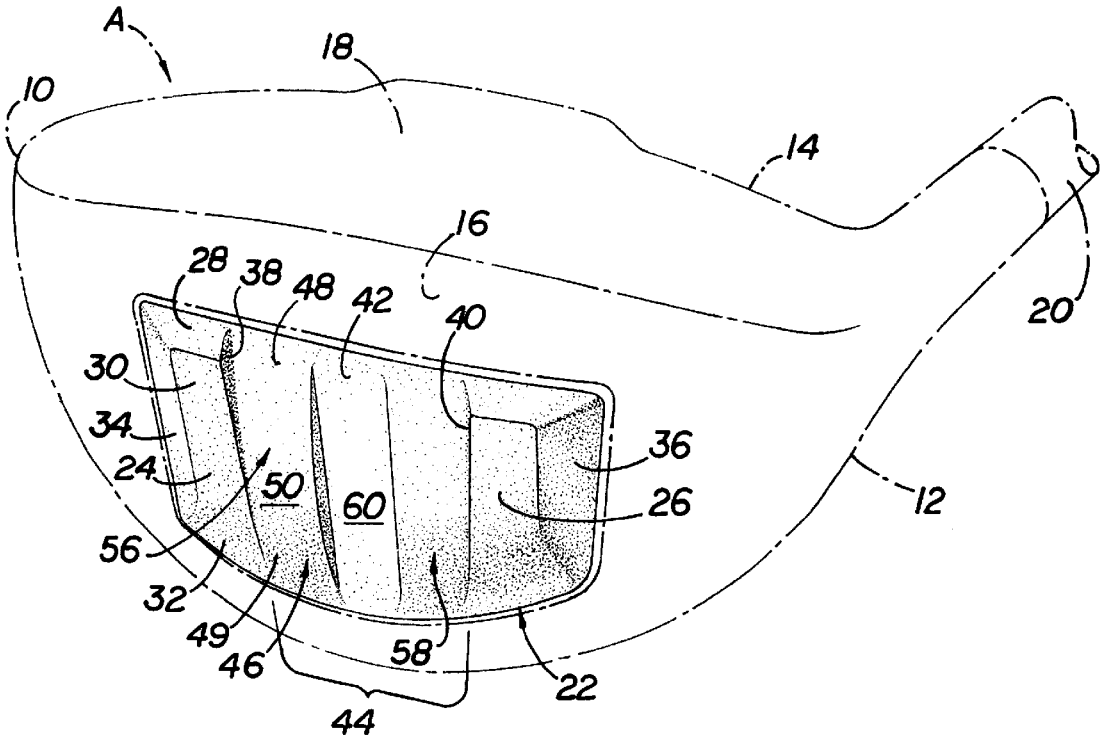
FIG. 1 is a worm's eye perspective view of a golf club head according to the present invention.
Figure 2:
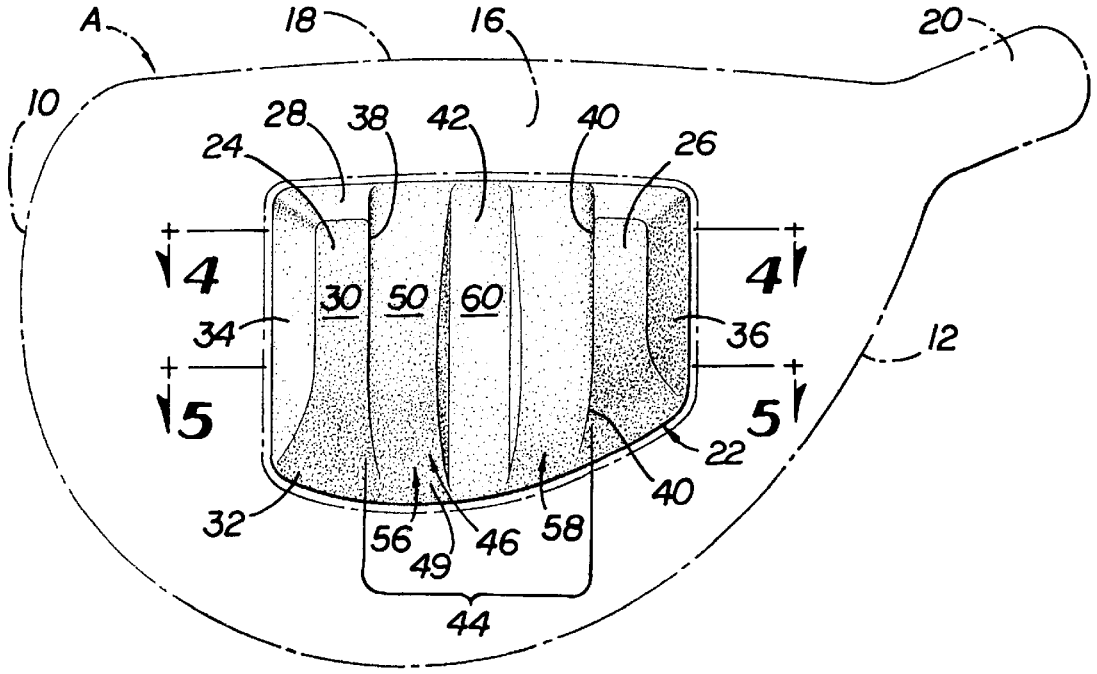
FIG. 2 is a bottom plan view of a golf club head according to the present invention.

Referring now in more detail to the drawings, the invention will now be described in more detail As shown in FIG. 1 golf club head A includes a toe portion 10, a heel portion 12, a crown portion 14 and a sole portion 16. The club further includes a front striking face 18 for contacting a golf ball which is surrounded by the toe, heel, top and sole portion. Hosel 20 incorporates a shaft for defining a golf club. Sole plate 22 is attached to sole portion 16. Sole plate 22 may either be integrally molded within sole portion 16 defining a unitary piece or may be separately crafted and then united with sole portion 16.

As shown in FIG. 1, sole plate 22 includes a raised first outside runner 24 and a raised second outside runner 26 which are of a general height. First and second outside runners extend along the sole in a direction from the face to the back of the club head. The runners are substantially parallel to each other and are offset from each other defining a deflection channel. First outside runner 24 includes a first front runner edge 28 which runs laterally along a portion of sole plate 22. First front runner edge depends downward from sole plate 22 at a slant to define the raised height of first outside runner 24. First front runner edge 28 transitions to first runner platform surface 30. First runner platform surface is generally horizontal and extends from intersecting with first front runner edge 28 towards the back of the sole.

First runner platform surface 30 is generally level and is designed to engage the ground when club head A is positioned at address of the golf ball. Second outside runner 26 is of similar construction as first outside runner 24. In the preferred embodiment, outside runners 24 and 26 include a back edge 32 which taper downward towards the rear of the sole from platform surface 30. Additionally first and outside second runners 24 and 26 include an outer sidewall 34 and 36 respectively which generally taper from sole portion 16 to platform surface 30 to define an outer surface along the length of the runner. Also first and second outside runners 24 and 26 include an inner sidewall 38 and 40 respectively which rises from sole portion 16 to platform surface 30 along the length of the respective runner to define inner surface 42.

In the preferred embodiment, the height of first outside runner 24 and second outside runner 26 are the same and is such that when club head A is resting on the ground at address the club head is square with the golf ball. Additionally, the profile of the runners provides surface area for engaging rough and the like enabling the runners to function as stabilizers stabilizing the golf club head as the golf club head engages the rough prior to engaging the golf ball. Also, the inner sidewalls 38, 40 of first and second outside runners 24, 26 provide the runners with a predefined edge which enables the runners to penetrate the ground.

Figure 3:
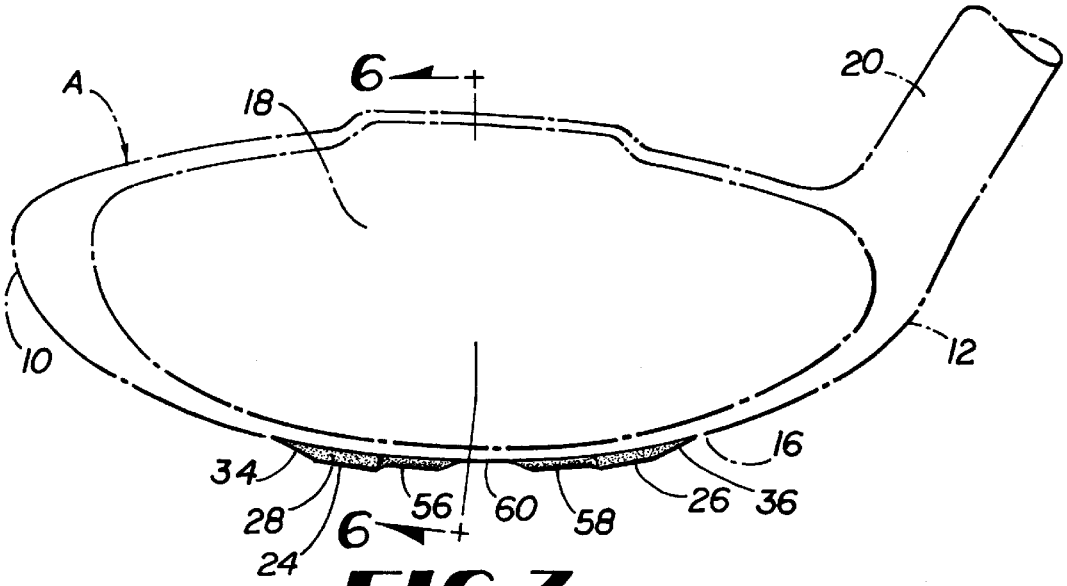
FIG. 3 is a front elevational view of a golf club head according to the present invention.
Figure 6:
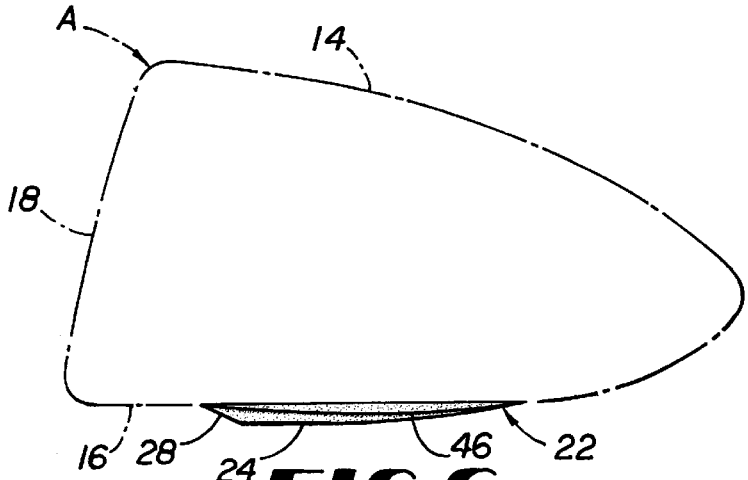
FIG. 6 is a cross-sectional view taken along line 6—6 of FIG. 3 illustrating the relationship between the inner and outer rails of the present invention.

First outside runner 24 is offset from second outside runner 26 to define deflection channel 44. Deflection element 46 is carried within deflection channel 44. Deflection element 46 extends along the sole in a direction from the front of the club head to the back of the club head. Deflection element 46 has front 48, rear 49, and an intermediary portion 50. The intermediary portion 50 rises from front 48 to rear 49 to a general height. As shown in FIG. 3, deflection element 46 has its lowermost point at front 48 and rises to a maximum height which is not greater than the height of first and second outside runners 24 and 26. As shown in FIG. 6, preferably, deflection element 46 rises to a height less than the height of first and second outside runners 24 and 26. Also preferably, the front of deflection element 46 is at a height level with the sole. The effect produced from the combination of deflection element 46 and first and second runners 24 and 26 is that the overall height of exposed inner sidewalls 38,40 are at their greatest when deflection element is at its lowest and is at its lowest when deflection element 46 is at its highest.

As shown in FIG. 1, deflection element 46 may consist of first inside runner 56 and second inside runner 58. Both runners are located within deflection channel 44. Preferably, first inside runner 56 is adjacent first outside runner 24 and second inside runner 58 is adjacent second outside runner 26. First and second inside runners 56,58 are offset defining central passageway 60. Preferably, first inside runner 56 and second inside runner 58 have a generally concave profile.

Figure 7:
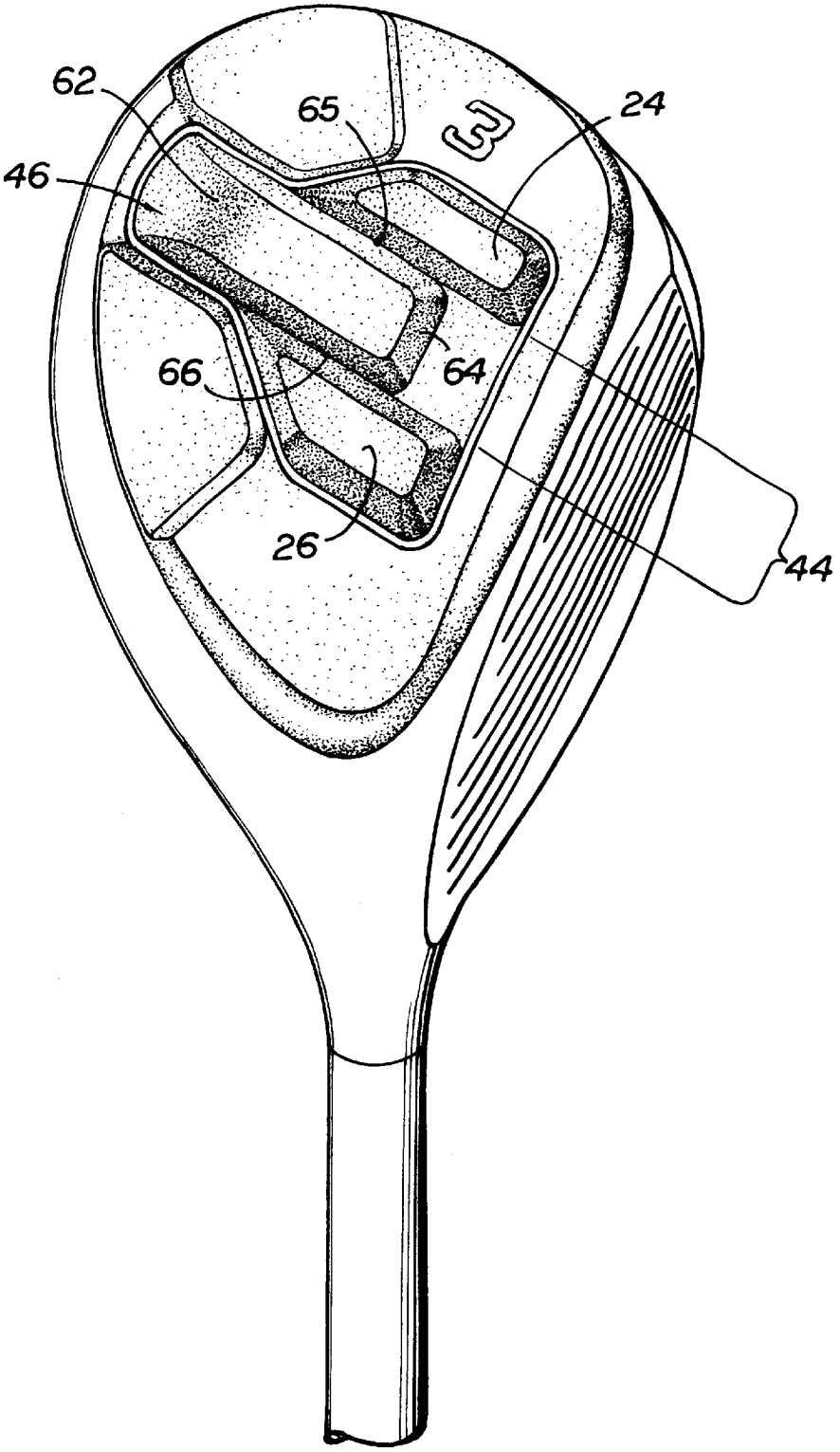
FIG. 7 is an alternative embodiment of the invention.

FIG. 7 illustrates an alternative embodiment of the invention. Deflection element 46 consists of a single deflector 62 located within deflection channel 44. Deflector 62 is of similar construction as first inside runner 56 but the front of deflector 64 is offset from the front runner edges of the first and second outside runners. Also, deflection element 46 is offset from both first outside runner 24 and second outside runner 26 defining two passageways 64 and 66 with the first passageway 64 between deflection element 46 and first outside runner 24 and the second passageway 66 between deflection element 46 and second outside runner 26.

As shown in FIGS. 3, 4, 5 and 6, inside runner 56 increases in height from the front of the club towards the rear and preferably does not exceed the height of first outside runner 24 but may be of equal height at the rear portion of the runners. The relationship between the level height of the outside runners and the variable increasing height of the inside runners creates a depth limitor which inhibits the time which the club head may be embedded in the ground when swung.

Figure 4:
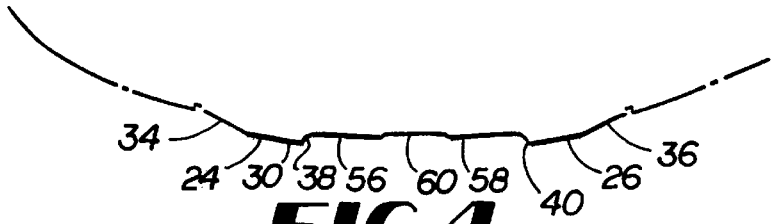
FIG. 4 is cross-sectional view taken along line 4—4 of FIG. 2 illustrating the relationship between the inner and outer rails of the present invention.
Figure 5:
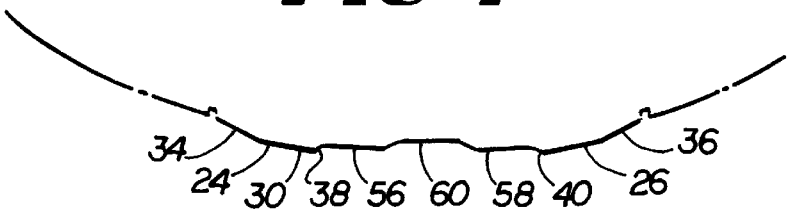
FIG. 5 is a cross-sectional view taken along line 5—5 of FIG. 2 illustrating the relationship between the inner and outer rails of the present invention.

Since metal woods are intended for use on fairways, roughs and bunkers, and woods, like irons, are swung in an arc, there may be a tendency for the golfer to inadvertently drive the sole of the club into the ground. As such a swing limits the performance of the wood, inhibiting the sole of the club from being embedded into the ground is a primary object of the invention. The initial engagement of the sole of the club with the ground is expected and encouraged and enables the runners to guide the clubhead in a straight path preventing twisting of the clubhead. However, the embedding of the golf wood into the ground is not desired, but due to the arcuate swing may occur. Accordingly, while initial embedding of the golf wood may occur due to the inside edges of the outside runners having an initial height, the golf club head is encouraged to lift from the embedment due to the inside runners effect on eliminating the inner sidewalls height progressively along the sole's profile. As shown in FIGS. 4, 5, and 6 as the height of the inside runners gradually increase the height of the inner sidewalls is reduced to the extent that no edge is available to become embedded into the ground. Accordingly, the inside runner's increase in height reduces the edge of the outside runner and results in deflecting the clubhead from the ground if the clubhead is embedded to a depth greater than the height of the inside runner.

We claim:

1. A golf club head having a front and a back and including a crown portion, a toe portion, a heel portion, and a sole portion wherein the improvement comprises:

a first and second outside runner carried by said sole portion and offset from one another defining a deflection channel;

said first and second outside runner each having a front edge depending from the sole portion to define a general height and transitioning to a generally level horizontal platform, said generally level horizontal platform extending in a front to back direction;

a deflection element carried within said deflection channel;

said deflection element having a front and a rear and an intermediary portion which extends from said front to said rear;

said intermediary portion rising from said front toward said rear to a general height; and said height of said intermediary portion of said deflection element not exceeding the height of said first and second outside runner.

2. The golf club head of claim 1 wherein said deflection element includes a first and second inside runner, said second inside runner being offset from said first inside runner and having a similar configuration as said first inside runner.

3. The golf club head of claim 2 wherein said first inside runner is adjacent said first outside runner and said second inside runner is adjacent said second outside runner.

4. The golf club head of claim 2 wherein said second insider runner is offset from said first inside runner defining a central passageway.

5. The golf club head of claim 1 wherein said front of said first inside runner is of a height level with said sole.

6. The golf club head of claim 1 wherein said intermediary portion of said first inside runner gradually rises from the front towards said rear to a transitionary point and therein gradually declines towards said rear defining a generally concave profile.

7. The golf club head of claim 1 wherein said deflection element is offset from said first and second outside runners creating two passageways, one between said deflection element and said first outside runner and another between the said deflection element and said second outside runner.

8. A runner system for a golf head having a sole comprising:

a first outside runner for being carried by said sole;

a second outside runner for being carried by said sole, said second outside runner being offset from said first outside runner for defining an internal passage;

a deflection element having a general length disposed between said first and second outside runner within said internal passage;

said first and second outside runners being of a general height; and said deflection element runner having a varying height along its length with said height not exceeding the general height of said first and second outside runners.

9. The runner system of claim 8 wherein said deflection element includes a first inside runner and a second inside runner disposed between said first and second outside runner within said internal passage.

10. The runner system of claim 9 wherein said first inside runner is adjacent said first outside runner and said second inside runner is adjacent said second outside runner.

11. The golf club head of claim 10 wherein said second insider runner is offset from said first inside runner defining a central passageway.

* * * * *